US006945911B2

(12) United States Patent
Jackowski

(10) Patent No.: US 6,945,911 B2
(45) Date of Patent: Sep. 20, 2005

(54) SYSTEM AND METHOD FOR PRESCRIBING A FITNESS PROGRAM

(75) Inventor: Edward Jackowski, New York, NY (US)

(73) Assignee: Edward, LLC, New York, NY (US)

( * ) Notice: Subject to any disclaimer, the term of this patent is extended or adjusted under 35 U.S.C. 154(b) by 266 days.

(21) Appl. No.: 09/903,791

(22) Filed: Jul. 12, 2001

(65) Prior Publication Data

US 2003/0017914 A1 Jan. 23, 2003

(51) Int. Cl.[7] ..... A63B 21/00
(52) U.S. Cl. ..... 482/9; 482/900; 600/481
(58) Field of Search ..... 482/1–9, 900; 600/300, 301, 481, 483

(56) References Cited

U.S. PATENT DOCUMENTS 3,675,640 A 7/1972 Gatts ..... 600/484
5,158,093 A 10/1992 Shvartz et al. ..... 600/520
5,738,612 A 4/1998 Tsuda ..... 482/8
6,280,396 B1 8/2001 Clark ..... 600/547
6,443,904 B2 9/2002 Nissila ..... 600/483

*Primary Examiner*—Glenn Richman
(74) *Attorney, Agent, or Firm*—Collen IP; Donald J. Ranft

(57) ABSTRACT

The present invention relates to a fitness program that considers a person's fitness level, fitness goals, and body type. Specifically, the present invention provides a system and method for prescribing a fitness program that includes the proper percentage of aerobic versus anaerobic exercise for a person, the specific exercises, the sequence of the exercises, and the preferred resistance for the selected exercises. The prescribed fitness program is based on the person's fitness level, fitness goals (goals such as losing weight, gaining strength, training for a particular sport, gaining mass, enhancing cardiovascular fitness, toning, etc.) and the person's body type. In the preferred embodiment of the present invention, there are four body type classifications with three fitness programs provided for each that correspond to three different fitness levels. The system and method of the present invention allows a person to achieve their fitness goals easier and more quickly than fitness programs prescribed by previous methods.

31 Claims, 12 Drawing Sheets

Hourglass

Hourglass

Spoon

Ruler

Cone

Figure 2a

| FITNESS GOAL (LEVEL) | FREQUENCY (Days per week) | DURATION (how long of a period) | INTENSITY (how hard you're working/THR) | TYPE (Aerobic/ Anaerobic % of time) |
|---|---|---|---|---|
| Weight Loss (For Sedentary Individual) | 4-6 days per week | 30-45 minutes | Low (THR 50%-60%) | 90% aerobic 10%anaerobic first 3 months<br>80% aerobic 20% anaerobic (after 3 months) |
| Toning (For Sedentary Individual) | 2-3 days per week | 25-40 minutes | Low (THR 55%-70%) | 60% aerobic 40% anaerobic first 3 months<br>50% aerobic 50% anaerobic (after 3 months) |
| Weight Loss (For Active/ Semi-Fit) | 4-6 days per week | 40-60 minutes | Moderate (THR 60%-75%) | 80% aerobic 20% anaerobic first 3 months<br>70% aerobic 30% anaerobic after 3 months |
| Toning (For Active/Semi Fit) | 2-4 days per week | 30-45 minutes | Moderate (THR 65%-80%) | 50% aerobic 50% anaerobic first 3 months<br>60% aerobic 40% anaerobic after 3 months |
| Weight Loss (For Very Active/Very Fit) | 4-6 days per week | 60-75 minutes | High (THR 75%-90%) | 70% aerobic 30% anaerobic first 3 months<br>60% aerobic 40% anaerobic after 3 months |
| Toning (For Very Active/Very Fit) | 3-4 days per week | 60-75 minutes | High (THR 80-95%) | 40% aerobic 60% anaerobic first 3 months<br>30% aerobic 70% anaerobic after 3 months |

Figure 2b

Body Type & Aerobic Exercise Chart

| Equipment | SPOON® | HOURGLASS® | RULER® | CONE® |
|---|---|---|---|---|
| Stationary Bike | * Use light tension/ high RPMs. | * Use light tension/ high RPMs. | ● Use tension | ● Use tension |
| Treadmill | * Fast walking with no incline is Okay. Never use an incline. | * Fast walking or running with no incline is Okay. Never use an incline. | * Use an incline to walk or run. | * Use an incline to walk or run. |
| Stair Climber | NR | NR | ● | ● |
| Rower | ● | * Use light resistance. | ● | * Use light resistance. |
| Ski Machine | * Use light resistance for lower body, high resistance for upper body. | * Use light resistance for lower body and upper body. | * Use resistance for upper and lower body. | * Use high resistance for lower body, light resistance for upper body. |
| Aerobic Rider (i.e.: HealthRider®) | * Use light resistance. | * Use light resistance. | ● | * Use light resistance. |
| Jump Rope | ● | ● | * May use weighted Jump Rope. | ● |
| Spinning<br>Elliptical<br>Stair climbers<br>Versa climbers<br>Step | NR | NR | ● Use resistance | * Use resistance for lower body. Do not use hand weights or resistance for upper body |

NR = Not recommended for this body type
• = Yes
* = Yes, with specific instructions

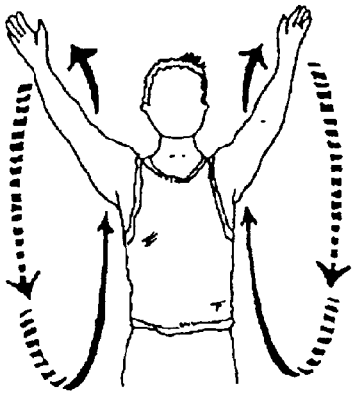
Fig. 3
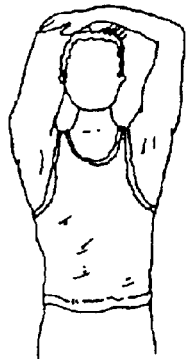
Fig. 4
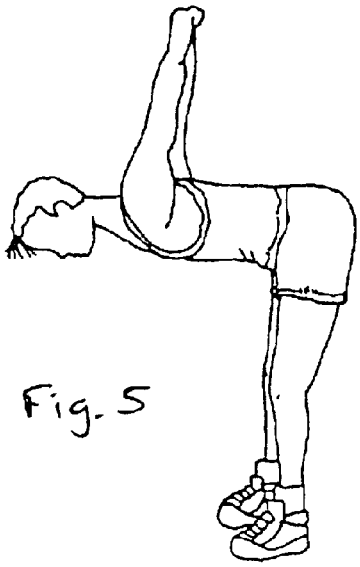
Fig. 5
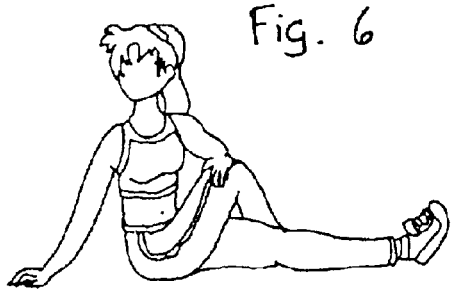
Fig. 6
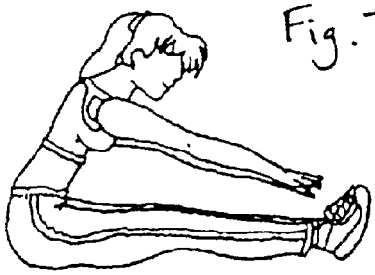
Fig. 7
Fig. 8
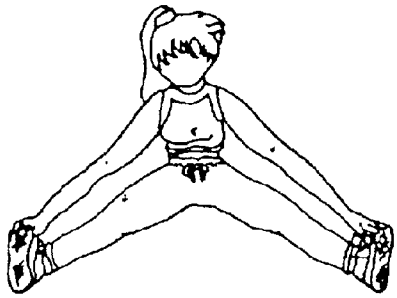

Fig. 19a
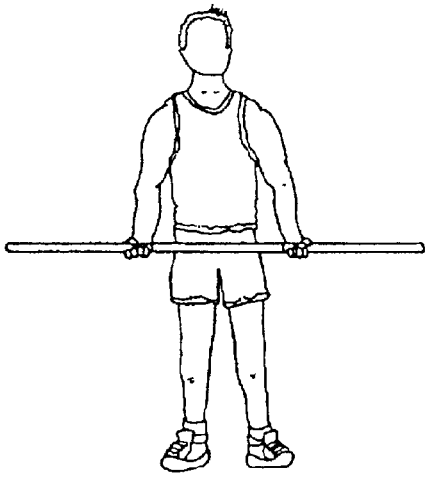
Fig. 18a
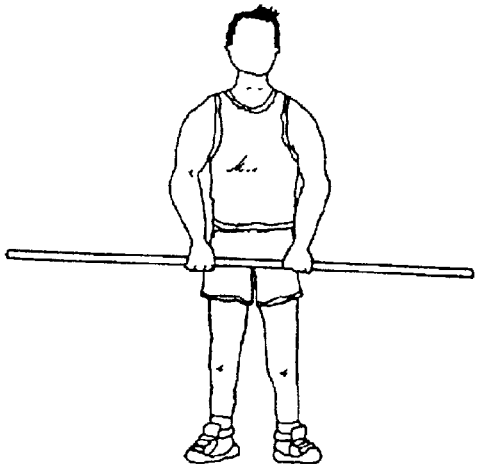
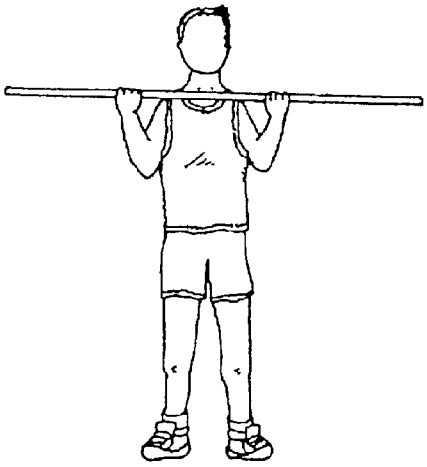
Fig. 19b
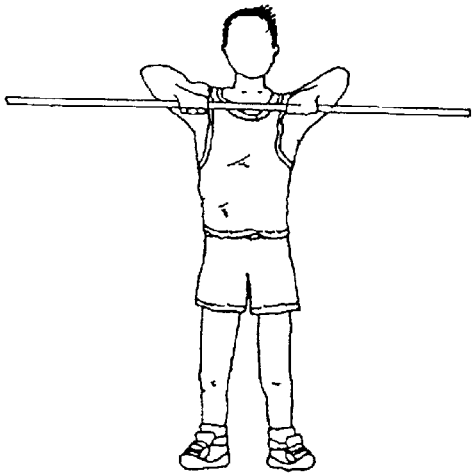
Fig. 18.b

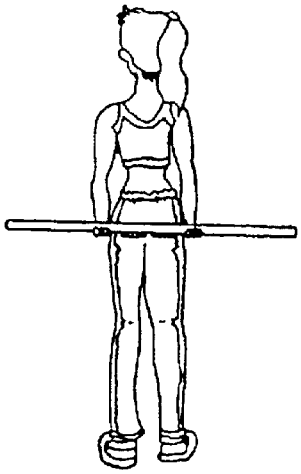
Fig. 20a
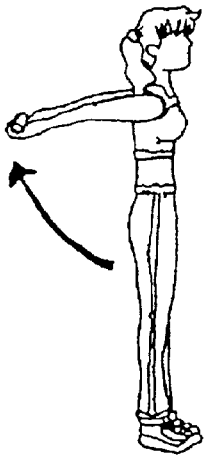
Fig. 20b
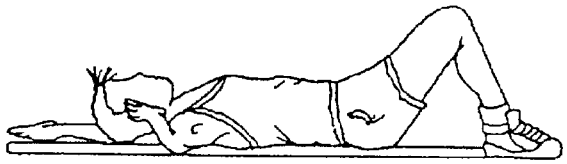
Fig. 21a
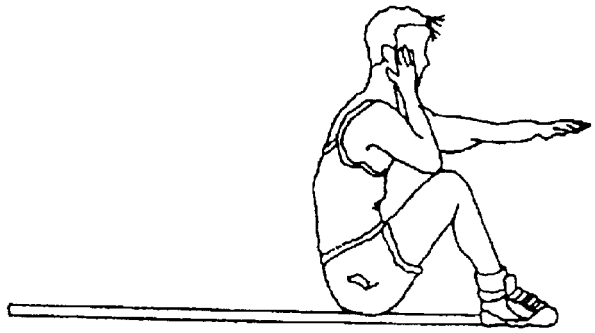
Fig 21b
Fig. 22a
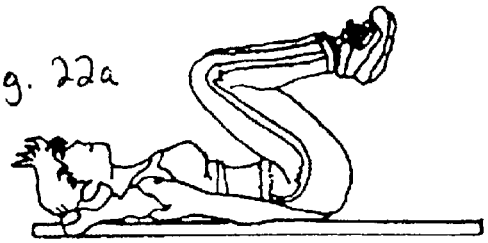
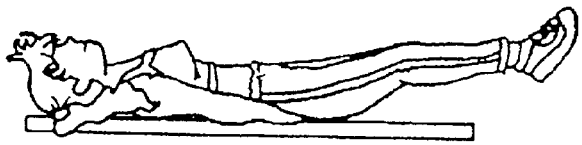
Fig. 22b

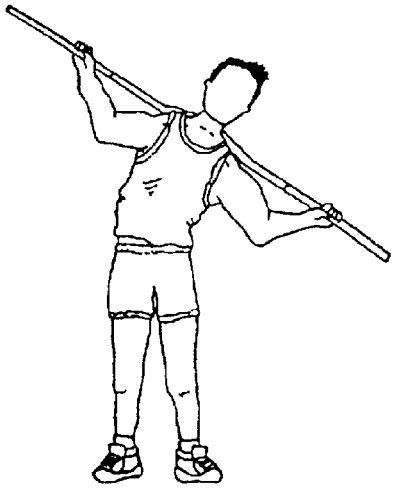
Fig. 28a
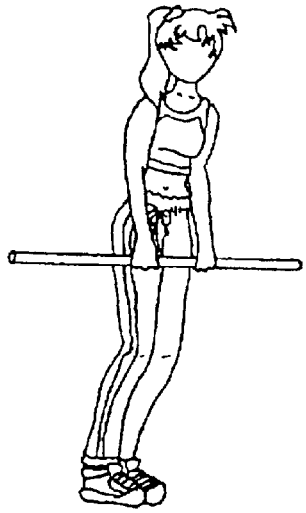
Fig. 29a
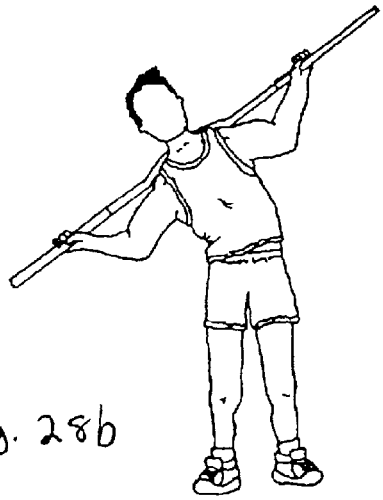
Fig. 28b
Fig. 29b
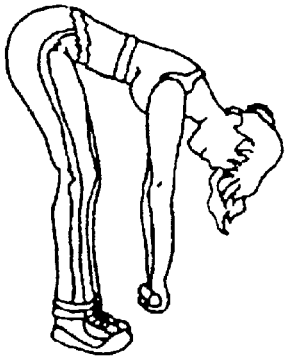
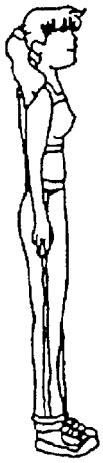
Fig. 30a
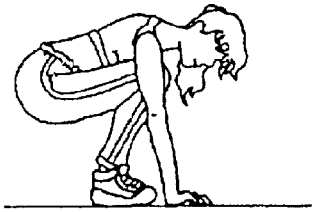
Fig. 30b
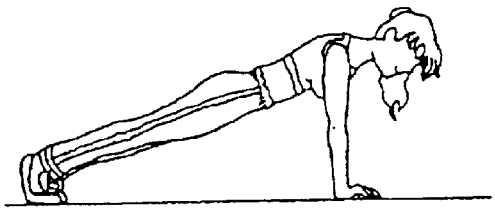
Fig. 30c

SYSTEM AND METHOD FOR PRESCRIBING A FITNESS PROGRAM

COPYRIGHT NOTIFICATION

Portions of this patent application contain materials that are subject to copyright protection. The copyright owner has no objection to the facsimile reproduction by anyone of the patent document, or the patent disclosure, as it appears in the Patent and Trademark Office.

BACKGROUND OF THE INVENTION

1. Field of Invention

The present invention relates, generally, to a fitness program that considers a person's fitness level, fitness goals, and body type to allow the person to reach their fitness goals more easily and quickly than methods of the prior art.

2. Discussion of the Background

The type of exercise one performs affects the type and the extent of changes resulting from the exercise, including changes apparent to one's body visually. In the prior art, aerobic exercise, such as running, biking, and stair climbing, is primarily recommended for burning fat and helps the body lose mass and weight. Conversely, anaerobic exercise, such as lifting weights, is recommended for building muscle and adds mass and weight.

In the prior art, the fitness goals of an individual (such as losing weight or gaining mass) have been the sole, primary factor in prescribing a fitness program for the individual. For example, traditionally, an overweight person is typically prescribed a fitness program that includes ample aerobic exercise and only moderate or no anaerobic exercise. In contrast, a person wishing to gain muscle is typically prescribed a fitness program with abundant anaerobic exercise and little or no aerobic exercise.

The prior art fitness programs, however, fail to recognize the fact that some aerobic exercises have an anaerobic affect. In addition, the prior art fitness programs are not designed with consideration of the fact that certain aerobic exercises with high resistance have an increased anaerobic affect on persons with certain body types. Furthermore, the prior art gives little regard to the type of aerobic exercise or the percentage of aerobic versus anaerobic exercise of the fitness program.

The present invention provides a fitness program that provides the proper percentage of aerobic vs. anaerobic exercise and with exercises selected that are based the person's fitness level, fitness goals, and body type, to allow the person to reach their goals easier and more quickly than the prior art methods.

SUMMARY OF THE INVENTION

The primary object of the present invention is to overcome the deficiencies of the prior art by providing a fitness program that considers a person's fitness level, fitness goals, and body type. Specifically, the present invention provides a means for prescribing the proper percentage of aerobic vs. anaerobic exercise for a person, based on the person's fitness level and fitness goals (goals such as losing weight, gaining strength, training for a particular sport, gaining mass, enhancing cardiovascular fitness, toning, etc.) as well as identifying the sequence of exercises, and the preferred resistance for such exercises, that are best suited to achieve those goals based on the person's body type.

Another objective of the present invention is to provide a system and method for prescribing a fitness program that allows a person to achieve their fitness goals easier and more quickly than fitness programs prescribed by methods in the prior art.

Yet another objective of the present invention is provide a fitness program that is customized for the person based on the person's fitness goals, fitness level, and body type.

BRIEF DESCRIPTION OF THE DRAWINGS

The accompanying drawings, which form part of this specification, illustrate various embodiments of the present invention and, together, with the description, further serve to explain the principles of the invention and to enable a person skilled in the pertinent art to make and use the invention.

A more complete appreciation of the invention and many of the attendant advantages thereof will be readily obtained as the same becomes better understood by reference to the following detailed description when considered in connection with the accompanying drawings, wherein:

FIGS. 2*a–b* depict a fitness schedule and aerobic exercise chart for an example embodiment of the present invention.

FIG. 3 illustrates a person performing arm circles.

FIG. 4 illustrates a person performing a tricep stretch.

FIG. 5 illustrates a person performing the upper back and chest stretch.

FIG. 6 illustrates a person performing the spine twist stretch.

FIG. 7 illustrates a person performing the hamstring stretch.

FIG. 8 illustrates a person performing the legs-apart hamstring stretch.

FIGS. 18*a–b* illustrate a person performing the upright row.

FIGS. 19*a–b* illustrate a person performing the bicep curls.

FIGS. 20*a–b* illustrate a person performing the tricep kickback.

FIGS. 21*a–b* illustrate a person performing sit-ups.

FIGS. 22*a–b* illustrate a person performing leg-outs.

FIGS. 28*a–b* illustrate a person performing side benders.

FIGS. 29*a–b* illustrate a person performing deadlifts.

FIGS. 30*a–b* illustrate a person performing squat thrusts.

DETAILED DESCRIPTION

Figure 1A:
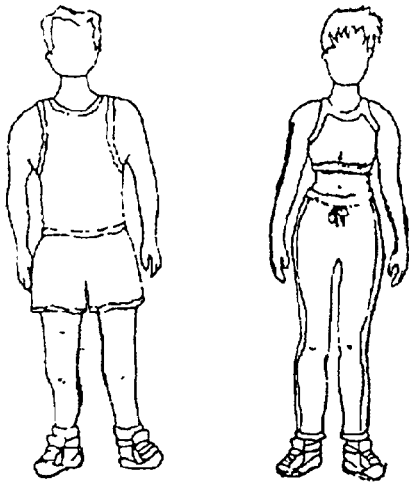
FIGS. 1*a–d* depict representative body type classifications according to the present invention.
Figure 1B:
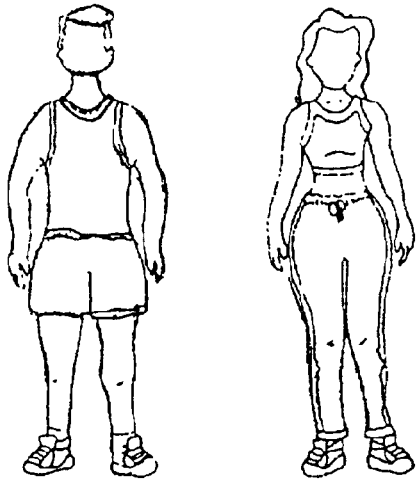
Figure 1C:
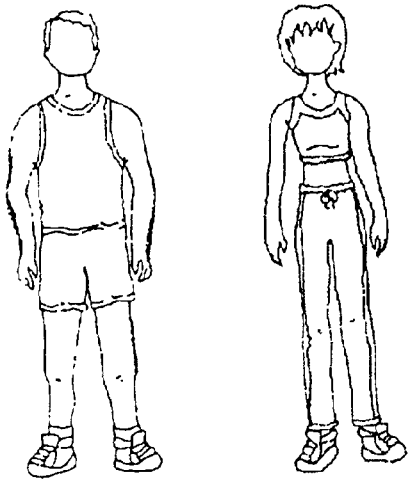
Figure 1D:
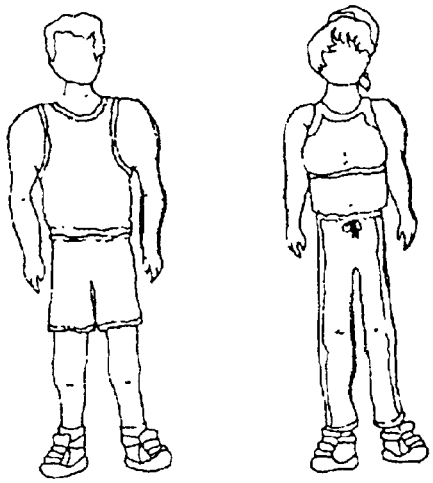

A person's body, for purposes of this discussion, is comprised of muscle, fat, and other substances (such as bone, organs, fluids, etc.). Muscle and fat are the two components of a person's body that can be manipulated by a fitness program. As a general matter, the girth of a muscle is proportional to the strength of the muscle. This is often, but not always, true. However, increase in girth is the most visually noticeable change that takes place as a result of regular and proper exercise. Another important consideration is that a muscle will grow in size and strength only when a workload over and above any previous demands is placed on it. The change in the size (or girth) and strength of a muscle is a natural reaction to stress placed on a muscle by exercises performed as part of a fitness program. Increasing amounts of stress leads to increases in muscle size. This principle of overload is one of the basic premises of resistance training.

Resistance training for hypertrophy requires pulling or pushing against a resistive force. The amount of hypertrophy may be increased by selecting a resistance that requires near-maximal effort for the individual, by moving against the resistance at an ever-increasing rate of speed that is approaching the maximum level of performance, or by a combination of the two. The speed of movement against the force, duration of the exercise, the number of repetitions, and vigor with which exercises are performed are important factors determining the amount of hypertrophy resulting from the fitness program. The physiological characteristics of individuals are also factors affecting the success of a fitness program. Two athletes of the same gender following identical fitness programs may not experience hypertrophy at the same rate, in the same manner, or to the same degree, because of varying inherent physical characteristics.

At a physiological level, most agree that hypertrophy is caused by a development of the existing constituent fibers and an increase in the total number of capillaries (which result from the endurance of the fitness program). In other words, a gain in strength is accompanied by a resultant gain not only in power, but also in speed and endurance.

As is well-known in the art, a person's physical traits are genetically programmed from birth. A person's genetics not only determine whether a person is born with a big nose or small ears, but also determine the person's body type. A body type, according to the present invention, is simply a classification of a person's physique into a category that corresponds to where that person's body tends to be bulkiest and tends to gain fat and muscle.

Thus, a fitness program according to the present invention is prescribed identifying the person's body type. In the example embodiment of the present invention, four body types are established as shown in FIGS. 1*a–d*. Persons with a larger upper body and small lower body are classified into a first body type referred to as a Cone® body type. A person with a Cone body type typically has a chest and waist that are relatively close in measurement with hips and thighs that are significantly smaller than their chest.

A second body type, the Hourglass® body type, is used to characterize persons with a symmetrical upper and lower body and with a tapered midsection. Typically, a person with an Hourglass body type will have at least a six inch difference between their chest and waist and between their hips and waist. The girth of their chest and hips are normally relatively close in girth.

Next, persons with a small upper body and large lower body are classified into a third body type referred to as a Spoon® body type. A person with a Spoon body type has chest and waist that are relatively close in girth, but have a significant difference between the girth of their hips and chest.

Finally, persons with a body that is substantially the same size from top to bottom comprise a fourth body type referred to as a Ruler® body type. A person with a Ruler body type has a chest, waist, and hips that are relatively close in measurement.

As discussed, the body type of a particular person is driven by that person's genetics. For example, at a very basic level, women more often have a Spoon body type than men because women's physiques, as a general matter, are genetically programmed to have a bulkier lower body—relative to their upper body—than men. Consequently, the fact that a particular woman's physique is characterized as a Spoon body type is driven by the fact that she is a woman—her genetics.

Investigations into the body types of men and women have shown that they fall into one of the four classifications of body types according to the following table:

| Body Type | Female | Male |
|---|---|---|
| Cone | 10% | 30% |
| Hourglass | 40% | 20% |
| Spoon | 30% | 10% |
| Ruler | 20% | 40% |

Depending upon the body type, a person will tend to gain muscle in certain regions of their body at different rates. Consequently, the body types Hourglass, Spoon, Ruler, and Cone identify not only how a person is genetically built, but also where on the body (region), the person will gain muscle easiest. For example, a woman with a natural Spoon body type will gain muscle easier and more quickly in her lower body, such as in the thighs, than elsewhere on her body.

In addition, a person with a particular body type will tend to gain bulk (muscle and fat) easier in certain areas of their body than persons of a different body type. For example, a woman whose natural body type is a Spoon body type will gain muscle or fat easier and more quickly in the lower body area, such as in the thighs, than a woman whose natural body type is a Ruler body type or a man having Cone body type. Consequently, the body type of the person is a key factor in selecting the exercises for the fitness program for a person.

Furthermore, no matter which body type a person possesses, when a person is overweight, they tend to gain bulk more from any exercise or activity that builds muscle than someone who is less overweight or not overweight. This fact is a key consideration when selecting the percentage of aerobic versus anaerobic activity to perform.

Although genetics determine a person's body type, his or her current weight, and the types of exercises performed by the person influence the extent of the body type (e.g., how big or small a Spoon). Take, for example, two persons with a Spoon body type who are the same height, weight and similar girth measurements of their arms, chest, waist, hips, thighs and calves and who begin different fitness programs. If one performs exercises such as step classes, spinning, lunges and squats with heavy weights, and the other only walks for exercise, their girth measurements would not remain the same. The person who did the anaerobic exercises would be bigger in all regions of his or her body that he or she worked vs. the person who only walked, even if the person remained the same weight. Thus, the degree at which one gains muscle is also dependent on the type of exercise and the resistance level of the exercise.

With respect to the anatomical make up of the body, fat in a person's body lies directly under the skin and is a protective covering over muscle. When a person uses resistance training to increase muscle size, the muscle expands outward pushing the fat outwards thereby increasing the girth of the body part. This fact creates a dilemma for persons attempting to lose weight from a body part that has an over abundance of fat. When hypertrophy occurs, the fat on the outside of the muscle gets pushed outwards, hence adding size and mass to the body part that the person is seeking to reduce in size.

The fitness program of the present invention is designed recognizing the fact that some aerobic exercises have an anaerobic affect. It is commonly believed that anaerobic exercises build muscle while aerobic exercises accomplish fat loss and reduction in size. However, when an individual who genetically carries more fat in their lower body (e.g., a Spoon body type), engages in aerobic exercise that employs the lower body, but with a high resistance level, the exercise acts both aerobically and anaerobically. In other words, because of their body type, that person is building muscle faster in their lower body than the rate at which they are burning fat, which results in an increase in body part size.

Thus, depending on a person's body type, the more resistance (tension or weights) the person uses to aerobically exercise a particular region of their body, the bigger that area will get. Conversely, lighter resistance reduces or eliminates the anaerobic affect for individuals with body types that tend to bulk more easily in those regions of the body, resulting in reduction in the size of that area of the body.

Thus, depending on their current fitness level and individual body type, each person has the ability to gain or lose mass depending upon the variety (sort) of exercises the person performs. The fitness program of the present invention employs the appropriate percentage of aerobic vs. anaerobic exercise and the appropriate type of aerobic exercises (hypertrophy vs. non-muscle building) performed.

FIG. 2*a* provides an example of a fitness schedule according to the present invention. The left column in the schedule identifies the fitness goal and fitness level of the individual for whom a fitness program is to be prescribed. For example, in row two of the schedule, the goal of the person is weight loss and fitness level of the person is that of a sedentary individual. For each fitness goal and fitness level in the first column (for each row), four exercise criteria are prescribed in the adjacent four columns.

The first exercise criteria, which is found in the second column, is the frequency of exercise and is in units of days per week. In row two of the schedule, the sedentary person seeking weight loss is prescribed exercise from between four and six days per week. The second exercise criteria, which is found in the third column is exercise duration. In row two of the schedule, the sedentary person seeking weight loss is prescribed exercise lasting between thirty and forty-five minutes. The third exercise criteria, which is found in the fourth column is exercise intensity. In row two of the schedule, the sedentary person seeking weight loss is prescribed exercising at an intensity of between fifty and sixty percent of their maximum heart rate (calculated as 220 minus their age). Finally, the last column of the schedule prescribes a fourth criteria, which indicates the type of exercise. More specifically, the fourth criteria determines the percentage of aerobic versus anaerobic exercise. In row two of the schedule, the sedentary person seeking weight loss is prescribed an exercise program having activity that is ninety percent aerobic and ten percent anaerobic during the first three months of the fitness program, and eighty percent aerobic and twenty percent anaerobic thereafter.

Consequently, the schedule of FIG. 2*a* identifies the appropriate frequency, duration, intensity, and type (percentage of aerobic versus anaerobic activity) of exercise for a plurality of different fitness goals and fitness levels. The fitness goals and levels of this chart, however, are an example embodiment only. Additional fitness goals and fitness levels could be added along with corresponding exercise criteria should a wider spectrum of prescribed exercise criteria be desired or needed. In addition, additional criteria could be added to the chart to provide further instructions. For example, another column could be added to indicate the time of day a person should exercise, how long after or before eating the person should exercise, or to indicate dietary constraints and requirements.

FIG. 2*b* provides an aerobic exercise chart, which identifies recommended and non-recommended aerobic exercise equipment exercises for specific body types. The leftmost column of the chart lists aerobic exercise equipment such as a stationary bike, treadmill, and stair climber, which are listed in rows two, three and four, respectively. As their headings indicate, the remaining four columns correspond to the four body types of the example embodiment. Each cell in the chart has an entry that indicates whether the body type (identified at the top of the column) should employ the corresponding exercise equipment or performs the identified aerobic exercise (identified at the left of the row) as part of the person's aerobic exercise program. Each cell, in this example embodiment, may have one of three entries including, "Not recommended for this body type," "Yes," or "Yes" with specific instructions relating to the employment of the exercise by persons with that body type.

As previously discussed, person's with a particular body type tend to gain muscle in certain areas consistent with their body type. The gain in muscle in these areas may result from particular types of aerobic exercises that have an anaerobic affect on individuals with particular body types. The chart of FIG. 2*b* prescribes aerobic exercises (that result from the use of the identified exercise equipment) by factoring in the person's body type to reduce or eliminate the anaerobic affects of the aerobic exercise based on that person's body type. In addition, the chart identifies aerobic exercises (and equipment) that should be avoided by the person to avoid hypertrophy in the areas of their body that most easily gain muscle.

For example, stair climbers tend to have an anaerobic affect on the lower body of persons with a Spoon body type as those persons tend to gain muscle most easily in the lower portion of their body. Consequently, according to this example of the present invention, a person with a Spoon body type should not use a stair climber as indicated by "NR" in the corresponding cell of the chart. However, a person with a Spoon body type does not tend to gain mass in the upper portion of their body. Consequently, the chart indicates that persons with the Spoon body may use a rowing machine, which has little anaerobic affect on the lower body.

Similarly, the chart of FIG. 2*b* indicates that a person with a Spoon body type may exercise at a fast walk on a treadmill provided there is no incline used. A treadmill set to an incline increases the resistance of the exercise, thereby increasing the anaerobic affect on the lower portion of the body. Likewise, running provides more of an anaerobic affect on the lower body than walking. Thus, to limit the anaerobic affect on the lower body to those with a Spoon body type, the chart indicates that those persons should only use a treadmill that is not set to an incline and only at a fast walk.

The schedule and chart of FIGS. 2*a–b* are used to identify the appropriate exercises, and frequency, intensity, duration, and type of exercises. However, they do not, in themselves, provide a specific fitness program. The fitness programs described below are, however, designed according to the discussed factors above.

Hourglass Body Type Routines

Hourglass Beginner Routine

The following fitness program is customized for an Hourglass body type who is beginning a fitness program—the Beginner Core Routine. This program is to be performed three times per week with each session lasting approximately sixty minutes.

Warm-up: Ten to twenty minutes on a bike at fifty to seventy RPMs, with low tension or walking (with or without a treadmill) at 2.7 to 3.2 MPH with no incline.

Stretching routine: The stretching routine lasts for two to four minutes. Arm circles, shown in FIG. 3, are performed standing up straight, knees slightly flexed, feet shoulder width apart. With arms outstretched, the arms are circled slowly for five revolutions making as large of a circle as possible. After five revolutions are completed, the direction of the circle is reversed for five more revolutions.

Next, as shown in FIG. 4, tricep stretches are performed by holding both arms overhead and bending the right arm so that the right elbow is behind the head. The left palm is placed on the right elbow and gently presses the elbow rearward to accomplish a stretch in the shoulder and triceps. Arms are then switched and process and repeated.

As shown in FIG. 5, the upper back and chest stretch requires the person to bend forward at the waist, knees slightly bent, arms straight, and grasp the hands behind the back. The shoulders, chest, and back are stretched by gradually lifting the arms toward the shoulders.

Next, the spine twist is performed by sitting with both legs extending forward and in front and crossing the right leg over the left leg, by placing the right foot flat on the floor to the left of the left knee. As shown in FIG. 6, the person then turns their upper body clockwise (to the right) and places the right hand palm down on the floor behind them. With the left elbow pressing against the outside of the right knee, the stretch is accomplished by turning the torso as far to the right (clockwise) as possible while looking over the right shoulder. When finished, reverse arms and legs, and twist the torso in the opposite direction (counterclockwise).

As shown in FIG. 7, the hamstring stretch is performed while sitting with legs extended straight and in the front of the person. The person bends forward from the hips and reaches for the toes. If possible, the person should grab hold of the toes.

Referring to FIG. 8, the legs-apart hamstring stretch is also performed while sitting with legs extended, but with the legs spread apart as far as possible. The person bends forward at the waist moving the hands toward the ankles and grabs the ankles (or the toes if possible) and gently pulls the upper body forward and holds for the stretch.

Figure 9:
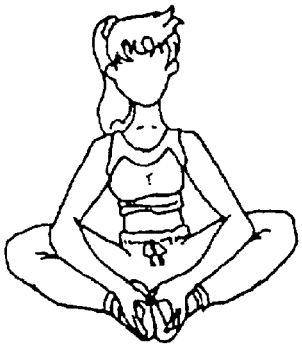
FIG. 9 illustrates a person performing the groin stretch.

Next, the groin stretch is performed in the seated position with the soles of the shoes together as shown in FIG. 9. The person then gently pulls the heels toward the groin letting the knee relax toward the floor. Then, the elbows may be pressed down on the knees to increase the stretch.

Figure 10:
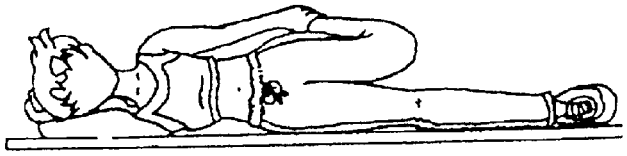
FIG. 10 illustrates a person performing the quadriceps stretch.

Referring to FIG. 10, the quadriceps stretch is performed lying down on the person's right side with the knee bent. The person grasps the left ankle with the left hand and gently pulls back towards the buttocks. Then, to stretch the other leg, the person releases, and rolls over, performs the same stretch.

Figure 11:
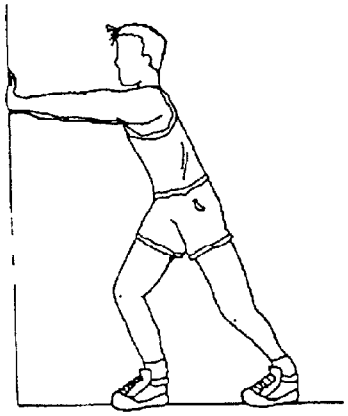
FIG. 11 illustrates a person performing a calf stretch.

As shown in FIG. 11, the calf stretch is performed with one leg forward bent at the knee and the other leg fully extended to the rear. The person then places both hands against a wall to control the lean forward while keeping the rear leg's heel on the floor. The person then switches leg positions to stretch the other calf.

Figure 12:
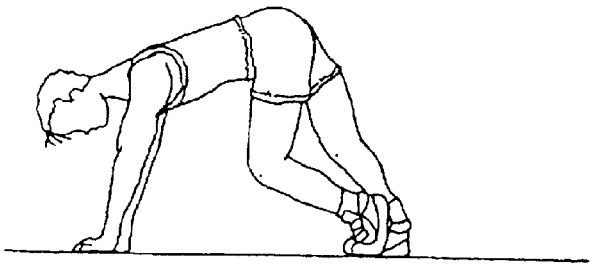
FIG. 12 illustrates a person performing an alternate calf stretch.

As an alternative calf stretch, the person gets down on all four limbs as shown in FIG. 12. The person straightens both legs keeping the palms flat on the floor and alternately presses each heel toward the floor.

After stretching, the person performs an aerobic interval of three minutes using either a bike at approximately sixty RPMs or walking at 3.2 MPH.

Figure 13A:
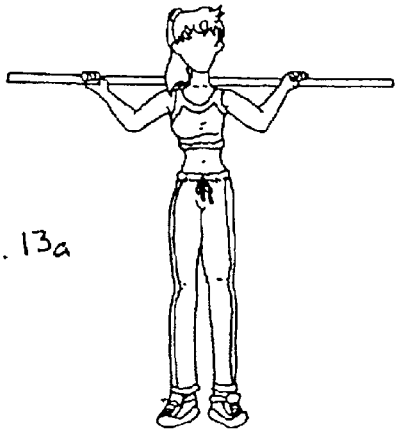
FIGS. 13*a–b* illustrate a person performing standing knee to opposite chest.
Figure 13B:
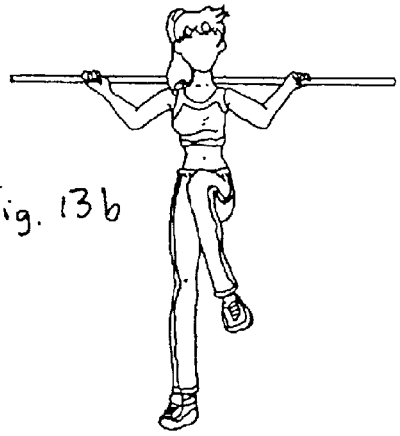

After the first aerobic interval, the person performs the first exercise sequence comprising the standing knee to opposite chest (SKOC) exercise followed by the L-kicks. As shown in FIGS. 13*a–b*, the SKOC exercise begins with a four pound aerobic bar across the shoulders and the feet shoulder width apart. The person transfers all weight to their left leg, raises their right leg up toward the left side of their chest to at least waist level, and then lowers the right leg to the floor. This exercise is performed for fifteen repetitions, after which the person switches legs.

Figure 14A:
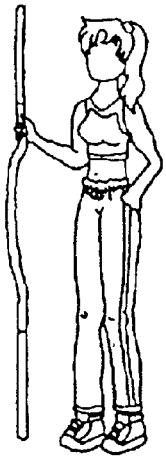
FIGS. 14*a–b* illustrate a person performing a L-kicks exercise.
Figure 14B:
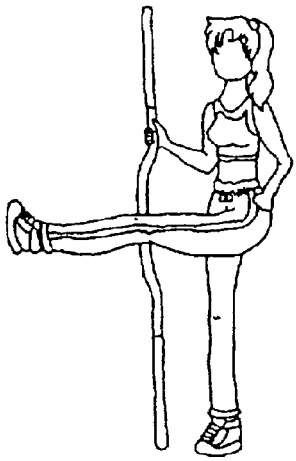
Figure 14C:
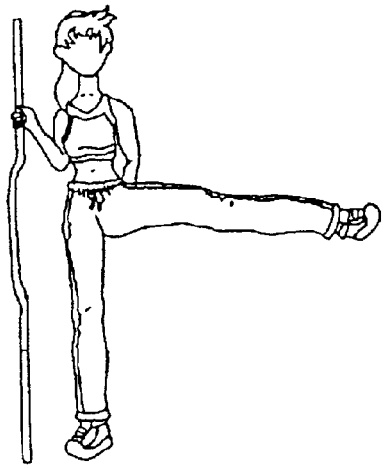
Figure 15A:
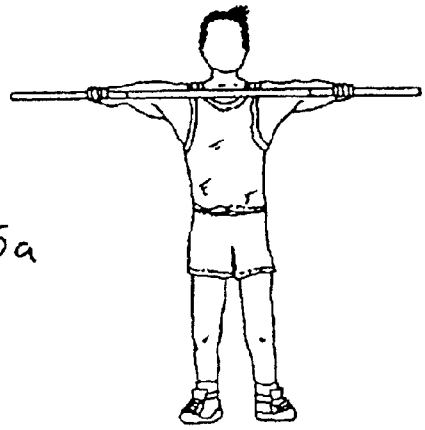
FIGS. 15*a–d* illustrate a person performing push-outs.
Figure 15B:
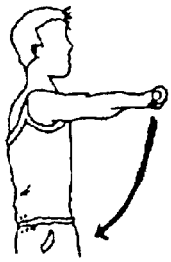
Figure 15C:
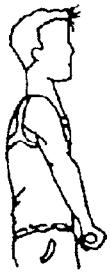
Figure 15D:
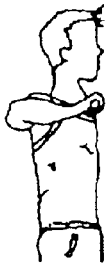

Referring to FIGS. 14*a–c*, L-kicks are performed holding the aerobic bar upright (or holding onto some other object to retain balance) with the right hand and with the left hand on the waist. Starting with the left leg, the person points the toes and gently raises the leg straight towards the front as high as possible and then returns the leg to the starting position. Next the person raises the leg to the side as high as possible and returns the leg to the starting position. These two movements are performed in sequence for fifteen repetitions for each leg.

Next, the person performs a second aerobic interval of three minutes using either a bike at approximately sixty RPMs or walking at 3.2 MPH.

After the second aerobic interval, the person performs their upper body routine, which includes fifteen repetitions per exercise for this body type. Referring to FIGS. 15*a–d*., push-outs, the first exercise, begin with the back straight, knees slightly bent, and feet shoulder width apart. The aerobic bar is gripped with the palms facing down, just wider than shoulder width apart. The person raises the bar up just above the chest line with elbows up and wrists firm. While exhaling, the person extends arms straight out holding the bar above chest level and then subsequently lowering the bar to the front of the thighs. The person then inhales as he or she raises the bar to the starting position at chest level. This exercise is performed for fifteen repetitions.

Figure 16A:
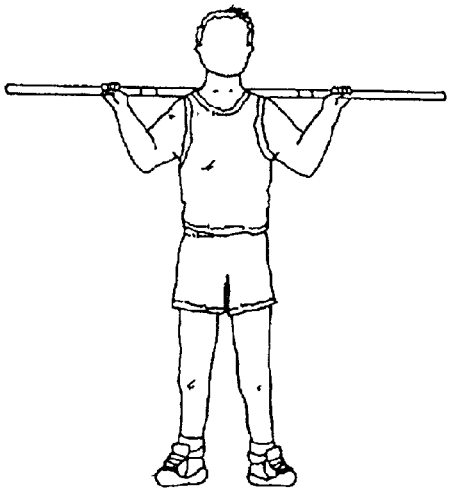
FIGS. 16*a–b* illustrate a person performing the behind-the-neck press.
Figure 16B:
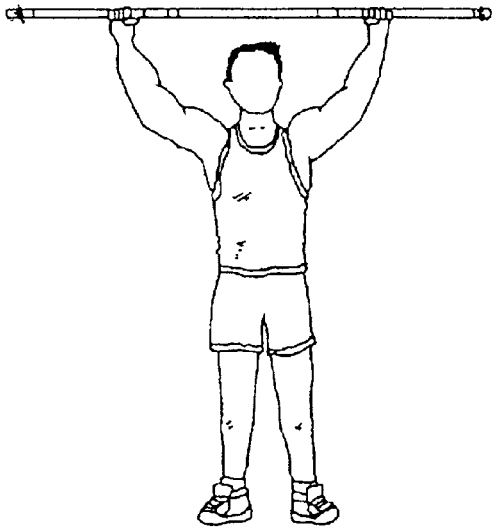

The second upper body exercise is the behind-the-neck press, which is shown in FIGS. 16*a–b*. In performing this exercise, the person keeps their back straight, knees flexed and feet shoulder width apart. The aerobic bar is gripped with the palms facing outward, just wider than shoulder width apart, resting the part lightly on the shoulders behind the neck. The arms are then extended straight up while exhaling to raise the bar overhead and then lowered to the start position while inhaling.

Figure 17A:
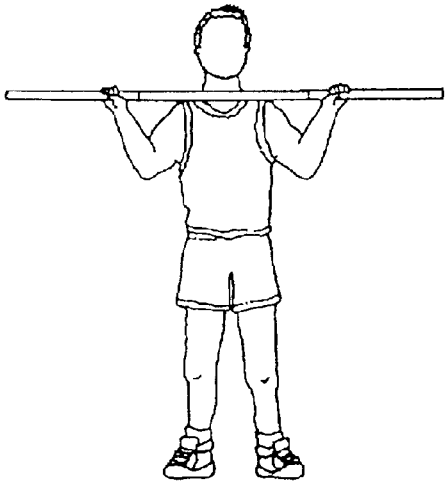
FIGS. 17*a–b* illustrate a person performing the front press.
Figure 17B:
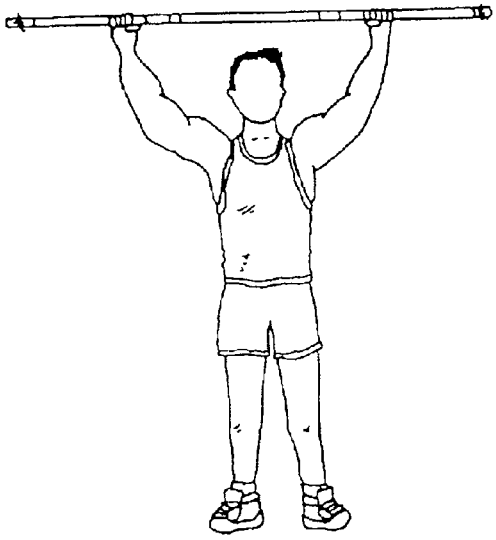

The third exercise in this upper body routine is the front press. Referring to FIGS. 17*a–b*, during this exercise the person keeps their back straight, knees flexed and feet shoulder width apart. The aerobic bar is gripped with the palms facing outward, just wider than shoulder width apart, with he bar across the top of the chest. The arms are then extended straight up while exhaling to raise the bar overhead and then lowered to the start position while inhaling.

Upright rows are the next exercise performed in this upper body routine and are illustrated in FIGS. 18*a–b*. This exercise is performed with the person's back straight, knees flexed and feet shoulder width apart. The aerobic bar is gripped with the palms facing down, and approximately six inches apart, with the arms fully extended and bar across the thighs. The bar is slowly raised to the chin, keeping the elbows above bar level, while exhaling. The bar is then lowered to the start position while inhaling.

The next exercise in this upper body routine is the bicep curl shown in FIGS. 19*a–b*. Throughout this exercise the person keeps the back straight, knees flexed and feet shoulder width apart. The aerobic bar is gripped with the palms facing up, hands shoulder width apart, with the arms fully extended and bar across the thighs. Keeping the wrists firm and elbows at the sides, the bar is slowly raised to the chest while exhaling. The bar is then lowered to the start position while inhaling.

Tricep kickbacks are the next exercise performed in this upper body routine and are illustrated in FIGS. 20*a–b*. This exercise is performed with the person's keeps back straight, knees flexed and feet shoulder width apart. The aerobic bar is gripped with the bar behind the back resting lightly against the buttocks with the palms facing outward. Keeping the wrists firm and elbows at the sides, the bar is slowly raised up and back while exhaling. The bar is then lowered to the start position while inhaling.

After the upper body routine, the person performs third aerobic interval of three minutes using either a bike at approximately sixty RPMs or walking at 3.2 MPH.

Next, the person performs the abdominal routine, which includes twenty repetitions per exercise and thirty seconds rest between exercises.

The first exercise of the abdominal routine is sit-ups and, as shown in FIGS. 21*a–b*, begin with the person laying on their back, knees bent, feet flat on the floor, and finger tips at the temples. The head and shoulders are slowly raised off the floor until the elbows touch the knees while exhaling. Then, while inhaling, the person returns to the start position.

Next, leg-outs, as shown in FIGS. 22*a–b*, begin with the person laying on their back, hands under the buttocks (palms down), and with the legs a few inches off the floor. The person then brings the knees toward the chest while inhaling and returns the legs to the start position (a few inches above the floor) while exhaling.

Figure 23A:
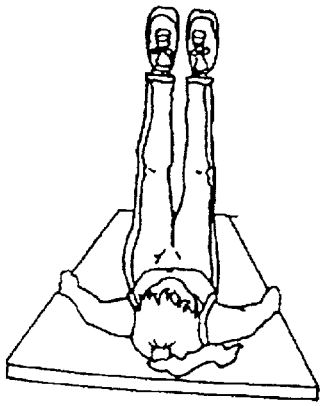
FIGS. 23*a–b* illustrate a person performing vertical scissors.
Figure 23B:
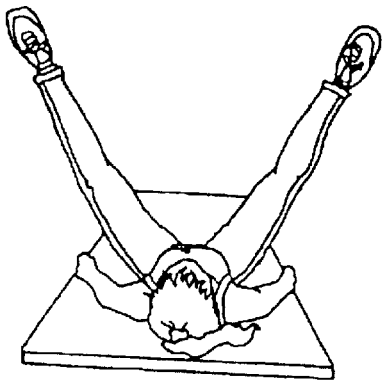

The next exercise of this routine is vertical scissors and, as shown in FIGS. 23*a–b*, begin with the person laying on their back, legs straight and at ninety degrees to the torso, knees bent, and hands at the sides, palms down. Pressing the back into the floor and with toes pointed, the person slowly spreads the legs apart as wide as possible while inhaling. Then, the legs are returned to the start position while exhaling.

Figure 24A:
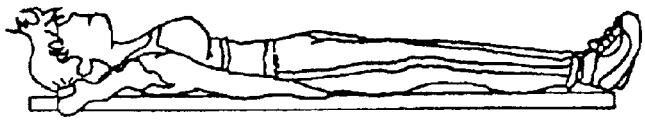
FIGS. 24*a–b* illustrate a person performing leg raises.
Figure 24B:
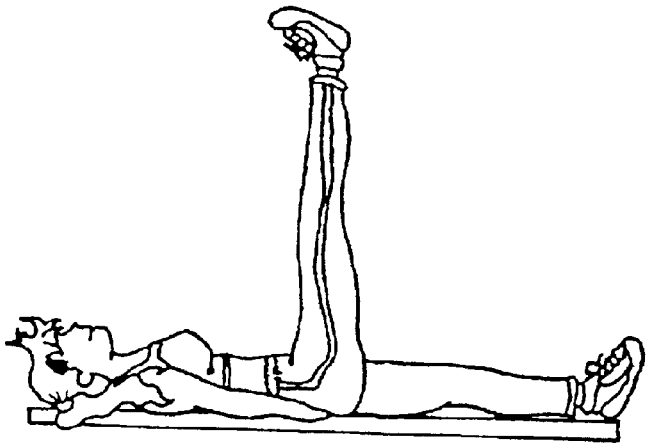

Alternate leg raises is the next exercise of this routine and, as shown in FIGS. 24*a–b*, begin with the person laying on their back, hands under the buttocks (palms down). With one leg a few inches off the floor, the other leg is raised to the vertical position. This motion is alternately repeated with each leg in a scissors motion.

Figure 25A:
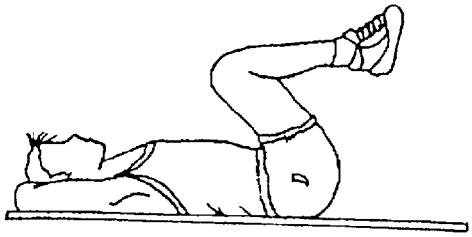
FIGS. 25*a–b* illustrate a person performing elbows to knees.
Figure 25B:
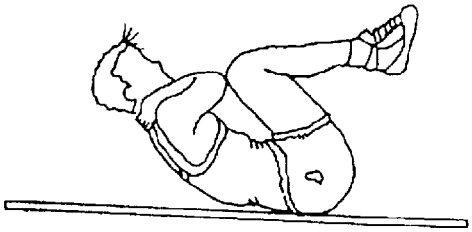

The next exercise of this routine is elbow to knees, shown in FIGS. 25*a–b*, begins with the person laying on their back, raised knees, feet toward the chest, and hands together at the base of the neck. The upper body is then curled bringing the elbows towards the knees while exhaling. The upper body is then are returned to the start position while inhaling. In this exercise, the lower body remains substantially motionless.

Figure 26A:
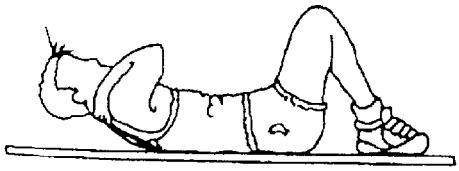
FIGS. 26*a–b* illustrate a person performing knees to elbows.
Figure 26B:
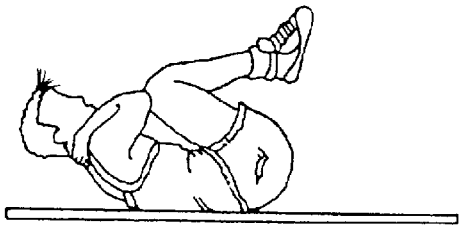

The next exercise of this routine is knees to elbows is shown in FIGS. 26*a–b* and begins with the person laying on their back, raised knees, feet toward the chest, and hands together at the base of the neck. The upper body is raised off the floor and remains motionless during this exercise. The knees are raised toward the elbows with the feet in the tuck position while inhaling and lowered to the start position while exhaling.

Next, the upper body routine described above is repeated again and includes the behind-the-neck press, front press, upright rows, bicep curls, and triceps kickbacks. Women use a four pound aerobic bar and men a weighted bar with fifteen repetitions per exercise and no rest between exercises.

After the repeated upper body routine, the person performs another aerobic interval of three minutes using either a bike at approximately sixty RPMs or walking at 3.2 MPH.

Finally, the person performs a cool down of two to three minutes of either leisurely biking or walking.

Those persons seeking to lose weight should perform a Beginner Off Day Routine two to three days per week on days in which the above core routine is not performed. The Off Day routine begins with a warm-up twenty to thirty three minutes using either a bike at approximately sixty RPMs or walking at 3.0 MPH. Next, the stretching routine discussed above are performed (arm circles, triceps, upper back and chest stretch, spine twist, hamstrings, legs-apart hamstrings, groin, quadriceps, and calves).

Next, the person performs twenty-five jumping jacks, which are well known in the art, followed by walking or biking for one minute. After the bike or walk, the person performs another set of twenty-five jumping jacks and another one minute bike or walk.

Finally, the person performs a cool down of two to three minutes of either leisurely biking or walking.

Hourglass Active Routine

Hourglass body types with a moderate fitness level should start with a more difficult fitness program referred to as the Active Core routine described below.

Warm-up: The person begins with a ten to twenty minute warm-up with a bike at between seventy and ninety RPMs with low tension or walking at 3.0 to 3.5 MPH. Next, the person performs the same stretching routine described above followed by a five minute aerobic interval of either biking at eighty plus RPMs, walking at 3.5 MPH, or jumping rope for one hundred jump, followed by a bike or walk for three minutes.

Next, the person performs the SKOC exercise followed by L-kicks, each with twenty-five repetitions exercise. a five minute aerobic interval of either biking at eighty plus RPMs, walking at 3.5 MPH, or jumping rope for one hundred jump, followed by a bike or walk for three minutes.

Next, the person performs a second five minute aerobic interval of either biking at eighty plus RPMs, walking at 3.5 MPH, or jumping rope for one hundred jump, followed by a bike or walk for three minutes. After the second aerobic interval, the upper body routine described above is performed with twenty-five repetitions per exercise and no rest between exercises. Men should use a weighted bar and women should use a four pound aerobic bar.

Next, the person performs a third five minute aerobic interval of either biking at eighty plus RPMs, walking at 3.5 MPH, or jumping rope for one hundred jump, followed by a bike or walk for three minutes. After the third aerobic interval, the abdominal, hip and thigh routine described above is performed with thirty repetitions per exercise and ten seconds rest between exercises. After the abdominal, hip and thigh routine, the upper body routine described above is performed again with twenty-five repetitions per exercise and no rest between exercises. Again, men should use a weighted bar and women should use a four pound aerobic bar.

Next, the person performs a third five minute aerobic interval of either biking at eighty plus RPMs, walking at 3.5 MPH, or jumping rope for one hundred jump, followed by a bike or walk for three minutes.

Finally, the person performs a cool down of two to three minutes of either leisurely biking or walking.

There is also an Active Off-Day routine for the person who performs the Active Core routine and who is seeking to lose weight. The Active Off-Day routine is performed two to three times per week on days in which the Active Core routine is not performed.

The Active Off-Day routine begins with a warm-up thirty minutes using either a bike at approximately eighty RPMs or walking at 3.5 MPH. Next, the stretching routine discussed above is performed (arm circles, triceps, upper back and chest stretch, spine twist, hamstrings, legs-apart hamstrings, groin, quadriceps, and calves).

Next, the person performs an aerobic interval of either fifty jumping jacks or jumping rope for one hundred jumps followed by walking or biking for one minute. Next the person perms twenty-five repetitions of SKOC and L-kicks followed by another set of fifty jumping jacks or jump rope followed by a one minute bike or walk.

Finally, the person performs a cool down of two to three minutes of either leisurely biking or walking.

Hourglass Very Active Routine

Persons with the Hourglass body types and best fitness level should start with an even more difficult fitness program referred to as the Very Active Core routine described below.

Warm-up: The person begins with a ten to twenty minute warm-up with a bike at between 90 and 110 RPMs with low tension or walking at 3.5 to 4.2 MPH. Next, the person performs the same stretching routine described above followed by a three minute aerobic interval of either biking at ninety plus RPMs, walking at 4.2 MPH, or jumping rope for two hundred jumps.

Next, the person performs the SKOC exercise followed by L-kicks, each with thirty-five repetitions exercise followed by the same three minute aerobic interval described in the previous paragraph.

After the second aerobic interval, the upper body routine previously described is performed with thirty-five repetitions per exercise and no rest between exercises. Men should use a weighted bar and women should use a four pound aerobic bar.

Next, the person performs a third three minute aerobic interval of either biking at ninety plus RPMs, walking at 4.2 MPH, or jumping rope for two hundred jumps. After the third aerobic interval, the abdominal, hip and thigh routine described above is performed with fifty repetitions per exercise and ten seconds rest between exercises. After the abdominal, hip and thigh routine, the upper body routine described above is performed again with forty repetitions per exercise and no rest between exercises. Again, men should use a weighted bar and women should use a four pound aerobic bar.

Next, the person performs a third three minute aerobic interval of either biking at ninety plus RPMs, walking at 4.2 MPH, or jumping rope for two hundred jumps.

Finally, the person performs a cool down of two to three minutes of either leisurely biking or walking.

There is also a Very Active Off-Day routine for the person who performs the Very Active Core routine and who is seeking to lose weight. The Very Active Off-Day routine is performed two to three times per week on days in which the Very Active Core routine is not performed.

The Very Active Off-Day routine begins with a warm-up of twenty minutes using either a bike at approximately ninety RPMs or walking at 4.0 MPH. Next, the stretching routine discussed above is performed (arm circles, triceps, upper back and chest stretch, spine twist, hamstrings, legs-apart hamstrings, groin, quadriceps, and calves).

Next, the person performs an aerobic interval of either seventy-five to one hundred jumping jacks or jumping rope for two minutes followed by biking or walking for one minute. Next the person fifty repetitions of SKOC and L-kicks followed by another aerobic interval as just described.

After the aerobic interval, the person performs the abdominal, hip, and thigh routine with fifty repetitions per exercise and no rest between exercises. Finally, the person performs another aerobic interval as most recently described followed by a cool down of two to three minutes of either leisurely biking or walking.

Spoon Body Type Routines

Spoon Beginner Routines

The following fitness program is customized for a Spoon body type who is beginning a fitness program—the Beginner Core Routine. This program is to be performed three times per week, with each session lasting approximately sixty minutes.

Warm-up: Ten to twenty minutes on a bike at fifty plus RPMs, with low tension or walking (with or without a treadmill) at 3.0 MPH with no incline.

Stretching routine: Next, the person performs the same stretching routine described above for the Hourglass body type.

After stretching, the person performs the SKOC exercises for twenty repetitions per leg. Next, the person performs push-ups, as are well-known in the art, for a total of ten repetitions. If possible, push-ups should be performed on the toes. However, if the person's fitness level does not permit push-ups on the toes, they should be performed on the knees (with the ankles crossed).

Next, the person engages in a three minute aerobic interval of biking at seventy RPMs or walking at least 3.0 MPH.

After the first aerobic interval, the upper body routine is performed. Women should use a ten pound curl bar and men should use a fifteen pound bar. All exercises should be performed for fifteen repetitions. The upper body routine exercises to be performed are push-outs, behind-the-neck press, front press, upright rows, bicep curls, and tricep kickbacks, all of which have been previously described.

After the upper body routine, a second three minute aerobic interval of biking at seventy RPMs or walking at least 3.0 MPH is performed. Next, the abdominal routine is performed, which includes a number exercises each performed for twenty-five repetitions and with thirty seconds rest between exercises. The exercises, in the order in which they are to performed, are sit-ups, leg-outs, vertical scissors, alternate leg raises, followed by another set of leg outs, alternate leg raises, followed by elbows to knees, and knees to elbows. Next, the person performs a set of SKOC for twenty repetitions followed by another three minute aerobic interval as described above for this body type.

Lastly, a cool down of two to three minutes of leisurely biking or walking is performed.

There is also a Beginner-Day routine for the person with the Spoon body type who is seeking to lose weight. The Beginner Off-Day routine is performed two to three times per week on days in which the Core routine is not performed. The Beginner Off-Day routine is described below.

Warm-up: Ten to twenty minutes on a bike at sixty plus RPMs, with low tension or walking (with or without a treadmill) at 3.0 MPH with no incline.

Stretching routine: Next, the person performs the same stretching routine described above for the Hourglass body type for three minutes.

After stretching, the person performs the SKOC for twenty repetitions followed by L-kicks for fifteen repetitions per leg. Lastly, a cool down of two to three minutes of leisurely biking or walking is performed.

Spoon Active Routine

Persons with a Spoon body type who have a moderate fitness level should perform the Active Core Workout described below.

Warm-up: Ten to twenty minutes on a bike at seventy plus RPMs, with low tension or walking (with or without a treadmill) at 3.5 MPH with no incline.

Stretching routine: Next, the person performs the same stretching routine described above for the Hourglass body type for three minutes.

After stretching the person performs SKOC exercise for thirty repetitions per leg and push-ups for twenty repetitions (on either knees or toes as is appropriate). Next, the person performs a three minute aerobic interval of either biking at least eighty RPMs or walking at 3.5 MPH.

After the first aerobic interval, the person performs the same upper body routine described for the beginner workout performing thirty-five repetitions per exercise.

After the upper body routine, the person performs a three minute aerobic interval of either biking at least seventy RPMs or walking at 3.0 MPH.

Next, the person performs forty repetitions of each of the following abdominal exercises in the stated order: sit-ups, leg-outs, vertical scissors, alternate leg raises, elbows to knees, and knees to elbows. After the abdominal exercises, the person performs the SKOC for thirty repetitions followed by an aerobic interval of three minutes of either biking at eighty or more RPM or walking at 3.5 MPH. Lastly, the person performs a two to three minute cool down of leisurely biking or walking.

There is also an Active Off-Day routine for the person who performs the Active Core routine and who is seeking to lose weight. The Very Active Off-Day routine is performed two to three times per week on days in which the Active Core routine is not performed. The Active Day-Off routine for the Spoon body type is described below.

Warm-up: Thirty minutes on a bike at eighty RPMs or walking (with or without a treadmill) at 3.5 MPH with no incline.

Stretching routine: Next, the person performs the same stretching routine described above for the Hourglass body type for three minutes.

After stretching, the person jumps rope for three to five minutes—biking or walking intermittently should the person need to catch their breath. Next, the person performs the SKOC for thirty repetitions followed by another session of jump rope for three to five minutes (—biking or walking intermittently should the person need to catch their breath). Lastly, a cool down of two to three minutes of leisurely biking or walking is performed.

Spoon Very Active Routine

Persons with a Spoon body type who have an advanced moderate fitness level should perform the Very Active Core Workout described below.

Warm-up: Ten to twenty minutes on a bike at ninety plus RPMs, with low tension or walking (with or without a treadmill) at 4.0 MPH with no incline.

Stretching routine: Next, the person performs the same stretching routine described above for the Hourglass body type for three minutes.

After stretching the person performs SKOC exercise for forty repetitions per leg and push-ups for thirty repetitions (on either knees or toes as is appropriate). Next, the person performs a three minute aerobic interval of jumping rope for two hundred jumps followed by either biking at least ninety RPMs or walking at 4.0 MPH. After the first aerobic interval, the person performs the same upper body routine described for the beginner workout performing fifty repetitions per exercise.

After the upper body routine, the person performs a second three minute aerobic interval as described in the previous paragraph. Next, the person performs fifty repetitions per exercise for each of the abdominal exercises of sit-ups, leg-outs, vertical scissors, alternate leg raises, elbows to knees, and knees to elbows. After the abdominal exercises, the person performs the SKOC for forty repetitions per leg followed by the same aerobic interval most recently described. Lastly, the person performs a two to three minute cool down of leisurely biking or walking.

There is also a Very Active Off-Day routine for the person who performs the Very Active Core routine and who is seeking to lose weight. The Very Active Off-Day routine is performed two to three times per week on days in which the Very Active Core routine is not performed. The Very Active Day-Off routine for the Spoon body type is described below.

Warm-up: Twenty minutes on a bike at a minimum of one hundred RPMs or walking (with or without a treadmill) at 4.0 MPH with no incline.

Stretching routine: Next, the person performs the same stretching routine described above for the Hourglass body type for three minutes.

After stretching, the person jumps rope for five to ten minutes—biking or walking intermittently should the person need to catch their breath. Next, the person performs the SKOC for forty repetitions followed by another session of jump rope for five to ten minutes (—biking or walking intermittently should the person need to catch their breath). Lastly, a cool down of two to three minutes of leisurely biking or walking is performed.

Ruler Body Type Routine

Ruler Beginner Routine

The following fitness program is customized for a Ruler body type who is beginning a fitness program—the Beginner Core Routine. This program is to be performed three times per week, with each session lasting approximately sixty minutes.

Warm-up: Ten to twenty minutes on a bike at fifty plus RPMs, with moderate tension or walking (with or without a treadmill) at 2.7 MPH at a slight incline.

Stretching routine: Next, the person performs the same stretching routine described above for the Hourglass body type for two to four minutes.

After stretching, the abdominal routine is performed, which includes a number exercises each performed for twenty repetitions. The exercises, in the order in which they are to be performed, are sit-ups, leg-outs, elbows to knees, and knees to elbows.

Next, the person engages in a five minute aerobic interval of biking at fifty or more RPMs with moderate tension or walking at 2.7 MPH at a slight incline or using an elliptical trainer or stepper with moderate tension.

Figure 27A:
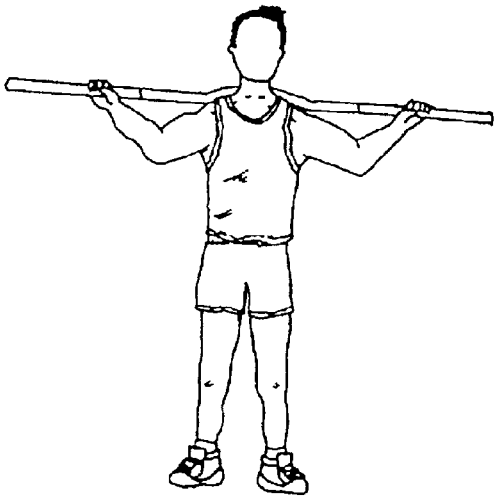
FIGS. 27*a–b* illustrate a person performing march in place on toes.
Figure 27B:
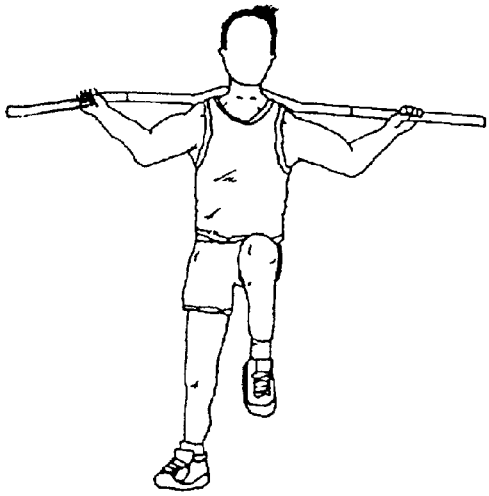

After the aerobic interval, the person marches in place on their toes for fifty repetitions. As shown in FIGS. 27*a–b*, this exercise is performed with the aerobic bar across the shoulders and feet shoulder width apart. The person raises themselves up on their toes, lifts the left knee straight up to at least waist high, and then lowers the left foot to the starting position. The up and down motion is then performed with the right leg to complete one repetition.

Next, the person performs fifteen to twenty repetitions of side benders, which begins with the aerobic bar across the shoulders. As shown in FIGS. 28*a–b*, the person bends sideways at the waist to the right, and then to the left to complete on repetition. The lower body remains still.

After side benders, the person performs deadlifts for ten to twenty repetitions, which are illustrated in FIGS. 29*a–b*. The bar is gripped with the hands shoulder width apart, palms down, arms fully extended and the bar resting lightly on the thighs. Keeping the elbows at the sides, feet six inches apart, and knees slightly bent, the person bends at the hips, lowering the bar as far as possible while inhaling. The bar should almost brush the front of the legs on the way down. The person then straightens to the start position while exhaling. The back remains straight from the hips up throughout this exercise.

Next, the person performs the upper body routine described above for the Hourglass body type performing fifteen repetitions per exercise. After the upper body routine, the person engages in another five minute aerobic interval of biking at fifty or more RPMs with moderate tension or walking at 2.7 MPH at a slight incline or using an elliptical trainer or stepper with moderate tension. Next, the person performs a set of march in place on the toes for fifty repetitions followed by a set of side benders for fifteen to twenty repetitions repetitions.

Next, the person performs another abdominal routine consisting of twenty repetitions of sit-ups, leg-outs, elbows to knees, knees to elbows, and another set of sit-ups (in that order). Finally, the person performs another set of deadlifts for ten to fifteen repetitions followed by a cool down of two to three minutes of either leisurely biking or walking, subsequently followed by stretching of the hamstrings.

There is also a Beginner Off-Day routine for the person with the Ruler body type who is seeking to lose weight. The Beginner Off-Day routine is performed two to three times per week on days in which the Core routine is not performed. The Beginner Off-Day routine is described below.

Warm-up: Thirty minutes on a bike at sixty plus RPMs, with moderate tension or walking (with or without a treadmill) at 2.7 MPH at a slight incline.

Stretching routine: Next, the person performs the same stretching routine described above for the Hourglass body type for three minutes.

After stretching, the person performs the abdominal exercises (twenty repetitions per exercise) of sit-ups, leg-outs, elbows to knees, and knees to elbows. Next, the person performs two sets up push-ups for repetitions each, resting thirty seconds between sets.

Lastly, the person performs a cool down of two to three minutes of either leisurely biking or walking, subsequently followed by stretching the hamstrings.

Ruler Active Routine

Persons with a Ruler body type who have a moderate fitness level should perform the Active Core routine described below.

Warm-up: Ten to twenty minutes on a bike at seventy or more RPMs, with moderate to high tension or walking (with or without a treadmill) at 5.0 MPH at a slight incline or using an elliptical or stepper with moderate to high resistance.

Stretching routine: Next, the person performs the same stretching routine described above for the Hourglass body type for two to four minutes.

After stretching, the abdominal routine is performed, which includes a number exercises each performed for forty repetitions. The exercises, in the order in which they are to be performed, are sit-ups, leg-outs, elbows to knees, and knees to elbows.

Next, the person engages in a five minute aerobic interval of biking at seventy or more RPMs with moderate to high tension or walking at 5.0 MPH at a slight incline or using an elliptical trainer or stepper with moderate to high resistance.

After the aerobic interval, the person marches in place on their toes for seventy-five repetitions followed by one minute of performing side benders.

After side benders, the person performs deadlifts for fifty repetitions followed by the upper body routine described above for the Hourglass body type performing twenty-five repetitions per exercise. After the upper body routine, the person engages in another five minute aerobic interval of biking at seventy or more RPMs with moderate to high tension or walking at 5.0 MPH at a slight incline or using an elliptical trainer or stepper with moderate to high resistance. Next, the person performs a set of march in place on the toes for seventy-five followed by a set of side benders for one minute.

Next, the person performs another abdominal routine consisting of forty repetitions of sit-ups, leg-outs, elbows to knees, and knees to elbows (in that order) followed by another set of deadlifts for fifty repetitions Lastly, the person performs a cool down of two to three minutes of either leisurely biking or walking, subsequently followed by stretching the hamstrings.

There is also an Active-Day routine for the person with the Ruler body type who is seeking to lose weight. The Active Off-Day routine is performed two to three times per week on days in which the Core routine is not performed. The Active Off-Day routine is described below.

Warm-up: Thirty minutes on a bike at eighty or RPMs, with moderate tension to high tension or jogging at 5.0 MPH at a slight incline or using an elliptical or stepper with moderate to high tension.

Stretching routine: Next, the person performs the same stretching routine described above for the Hourglass body type for three minutes.

After stretching, the person performs the abdominal exercises (forty repetitions per exercise) of sit-ups, leg-outs, elbows to knees, and knees to elbows followed by a five to ten minute aerobic interval of jump rope, intermittently performing one minute of side benders as needed to allow the person to catch their breath.

Lastly, the person performs a cool down of two to three minutes of either leisurely biking or walking, subsequently followed by stretching the hamstrings.

Ruler Very Active Routine

Persons with a Ruler body type who have a high fitness level should perform the Very Active Core routine described below.

Warm-up: Ten to twenty minutes on a bike at ninety or more RPMs with high tension or running (with or without a treadmill) at 6.0 MPH at a steep incline or using an elliptical or stepper with high resistance.

Stretching routine: Next, the person performs the same stretching routine described above for the Hourglass body type for two to four minutes.

After stretching, the abdominal routine is performed, which includes a number exercises each performed for sixty repetitions. The exercises, in the order in which they are to be performed, are sit-ups, leg-outs, elbows to knees, and knees to elbows.

Next, the person engages in a five minute aerobic interval of biking at ninety or more RPMs with high tension or running at 6.0 MPH at a steep incline or using an elliptical trainer or stepper with high resistance.

After the aerobic interval, the person marches in place on their toes for one hundred repetitions followed by one minute of side benders.

After side benders, the person performs deadlifts for seventy-five repetitions followed by the upper body routine described above for the Hourglass body type performing forty repetitions per exercise. After the upper body routine, the person engages in another five minute aerobic interval of biking at ninety or more RPMs with high tension or running at 5.0 MPH at a steep incline or using an elliptical trainer or stepper with high resistance. Next, the person performs a set of march in place on the toes for one hundred repetitions followed by a set of side benders for one minute.

Next, the person performs another abdominal routine consisting of sixty repetitions of sit-ups, leg-outs, elbows to knees, and knees to elbows (in that order) followed by another set of deadlifts for seventy-five repetitions Lastly, the person performs a cool down of two to three minutes of either leisurely biking or walking, subsequently followed by stretching the hamstrings.

There is also a Very Active-Day routine for the person with the Ruler body type who is seeking to lose weight. The Very Active Off-Day routine is performed two to three times per week on days in which the Core routine is not performed. The Very Active Off-Day routine is described below.

Warm-up: Thirty minutes on a bike at one hundred or more RPMs with high tension or running at 6.0 MPH at a steep incline or using an elliptical or stepper with high tension.

Stretching routine: Next, the person performs the same stretching routine described above for the Hourglass body type for three minutes.

After stretching, the person performs the abdominal exercises (sixty repetitions per exercise) of sit-ups, leg-outs, elbows to knees, and knees to elbows followed two sets of push-ups performing five repetitions per set and with a thirty second rest between sets.

Next is in the routine is a five to ten minute aerobic interval of jump rope, intermittently performing one minute of side benders as needed to allow the person to catch their breath.

Lastly, the person performs a cool down of two to three minutes of either leisurely biking or walking, subsequently followed by stretching the hamstrings.

Cone Body Type Routine

Cone Beginner Routine

Persons with Cone body types who are new to fitness programs should perform the Cone Beginner Core routine, which is described below.

Warm-up: The person begins with a ten to twenty minute warm-up with a bike at between fifty or more RPMs with moderate tension or walking (with or without a treadmill) at 2.5 MPH using a slight incline or using an elliptical or stepper with moderate resistance.

Next, the person performs the same stretching routine described above for two to four minutes followed by a five minute aerobic interval of either biking at fifty plus RPMs, walking at 2.5 MPH or faster (with or without a treadmill) on a slight incline, using an elliptical or stepper with moderate resistance.

Next, the person performs an upper body routine for twenty repetitions per exercise. Men should use a ten pound curl bar and women should use a four pound aerobic bar. The exercises in the order that they are to be performed are push-outs, behind the neck press, front press, upright rows, bicep curls, and tricep kickbacks.

Next, the person performs deadlifts for between ten and thirty repetitions followed by five to fifty repetitions of side benders. After the side benders, the person performs the abdominal routine, which comprises twenty repetitions of sit-ups, leg-outs, elbows to knees, knees to elbows, and alternate leg raises.

After the abdominal routine, the person performs a second five minute aerobic interval of either biking at eighty plus RPMs, walking at 3.5 MPH, or jumping rope for one hundred jump, followed by a bike or walk for three minutes. After the second aerobic interval, the upper body routine described above is perform with twenty-five repetitions per exercise and no rest between exercises. Men should use a weighted bar and women should use a four pound aerobic bar.

Next, the person performs a third of either biking at fifty or more RPMs at moderate tension, walking at 2.5 MPH or faster (with or without a treadmill) on a slight incline, using an elliptical or stepper with moderate resistance After the aerobic routine, the person performs march in place on toes for twenty-five repetitions followed by another complete upper body routine as most recently described. Next the person performs another set of march in place on toes for twenty-five repetitions followed by abdominal routine of twenty repetitions of sit-ups, elbows to knees, and knees to elbows. Lastly, the person performs twenty-five to fifty repetitions of side benders followed by a cool down of two to three minutes of either leisurely biking or walking and thereafter stretching the hamstrings as necessary.

There is also a Beginner Off-Day routine for the person who performs the Beginner Core routine and who is seeking to lose weight. The Beginner Off-Day routine is performed two to three times per week on days in which the Beginner Core routine is not performed.

Warm-up: The Beginner Off-Day routine begins with a warm-up thirty minutes using either a bike at sixty RPMs or faster with moderate tension or walking at 2.7 MPH at a slight incline or using an elliptical trainer or stepper with moderate resistance. Next, the stretching routine discussed above is performed (arm circles, triceps, upper back and chest stretch, spine twist, hamstrings, legs-apart hamstrings, groin, quadriceps, and calves).

Next, the person performs twenty repetitions of abdominal exercises for each exercise and in the order of sit-ups, leg-outs, elbows to knees, and knees to elbows.

After the abdominal exercises, the person performs twenty repetitions of squat thrusts, which begin with the person's back straight, knees slightly bent and feet shoulder width apart. Referring to FIGS. 30*a–c*, from a standing position, the person tucks into a squat position with the thighs parallel to the mat, palms face down six inches in front of the toes and slightly wider than shoulder width apart. The person should exhale while kicking both legs straight out behind themselves, landing on the toes with legs fully extended. Then, the person thrust back as if sitting on a chair, the returns to the standing position to begin another repetition.

After squat thrusts, the person performs one minute of side benders followed by a cool down of two to three minutes of either leisurely biking or walking.

Cone Active Routine

Persons with a Cone body type who have a moderate fitness level should perform the Cone Active Core routine, which is described below.

Warm-up: The person begins with a ten to twenty minute warm-up with a bike at seventy or more RPMs with moderate to high tension or walking (with or without a treadmill) at 3.2 MPH using a slight incline or using an elliptical or stepper with moderate resistance.

Next, the person performs the same stretching routine described above for two to four minutes followed by a five minute aerobic interval of either biking at seventy or more RPMs, walking at 3.2 MPH or faster (with or without a treadmill) on a slight incline, using an elliptical or stepper with moderate to high resistance.

Next, the person performs the same upper body routine exercises describe for the Cone Beginner Core routine, but performing for thirty-five repetitions per exercise.

Next, the person performs deadlifts for forty repetitions followed by one minute of side benders. After the side benders, the person performs the abdominal routine, which comprises forty repetitions of sit-ups, leg-outs, elbows to knees, and knees to elbows.

After the abdominal routine, the person performs a second five minute aerobic interval of either biking at seventy or more RPMs with moderate to high tension, walking at 3.2 MPH on a slight incline, or using an elliptical trainer or stepper with moderate to high resistance. After the second aerobic interval, the person performs fifty repetitions of march in place on toes followed upper body routine just described for thirty-five repetitions per exercise.

Next, the person performs march in place on toes for fifty repetitions followed by another abdominal routine of forty repetitions of sit-ups, leg-outs, elbows to knees, and knees to elbows. Lastly, the person performs one minute of side benders followed by a cool down of two to three minutes of either leisurely biking or walking and thereafter stretching the hamstrings as necessary.

There is also an Active Off-Day routine for the person who performs the Active Core routine and who is seeking to lose weight. The Active Off-Day routine is performed two to three times per week on days in which the Active Core routine is not performed.

The Active Off-Day routine begins with a warm-up thirty minutes using either a bike at eighty or more RPMs with moderate tension, walking at 3.2 MPH on a slight incline or using an elliptical trainer or stepper with moderate to high resistance. Next, the stretching routine discussed above is performed (arm circles, triceps, upper back and chest stretch, spine twist, hamstrings, legs-apart hamstrings, groin, quadriceps, and calves) for two to four minutes.

Next, the person performs forty repetitions of abdominal exercises for each exercise and in the order of sit-ups, leg-outs, elbows to knees, and knees to elbows.

After the abdominal exercises, the person performs twenty repetitions of squat thrusts followed b one minute of side benders and another twenty repetitions of squat thrusts. Lastly, the person perform five minutes of jump rope followed by a cool down of two to three minutes of either leisurely biking or walking.

Cone Very Active Routine

Persons with a Cone body types who have a high fitness level should perform the Cone Very Active Core Routine, which is described below.

Warm-up: The person begins with a ten to twenty minute warm-up with a bike at one hundred or more RPMs with high tension or walking (with or without a treadmill) at 4.0 MPH using a steep incline or using an elliptical or stepper with high resistance.

Next, the person performs the same stretching routine described above for two to four minutes followed by a five minute aerobic interval of either biking at one hundred or more RPMs with high tension, walking at 4.0 MPH or faster (with or without a treadmill) on a steep incline, or using an elliptical or stepper with high resistance.

Next, the person performs the same upper body routine exercises describe for the Cone Beginner Core routine, but performing for fifty repetitions per exercise.

Next, the person performs deadlifts for sixty repetitions followed by one minute of side benders. After the side benders, the person performs the abdominal routine, which comprises fifty repetitions of sit-ups, leg-outs, elbows to knees, and knees to elbows.

After the abdominal routine, the person performs a second five minute aerobic interval of either biking at one hundred or more RPMs with high tension, walking at 4.0 MPH or faster on a steep incline, or using an elliptical trainer or stepper with to high resistance. After the second aerobic interval, the person performs seventy-five repetitions of march in place on toes followed upper body routine just described for fifty repetitions per exercise.

Next, the person performs march in place on toes for seventy-five repetitions followed by another abdominal routine of sixty repetitions of sit-ups, leg-outs, elbows to knees, and knees to elbows. Lastly, the person performs one minute of side benders followed by a cool down of two to three minutes of either leisurely biking or walking and thereafter stretching the hamstrings as necessary.

There is also an Very Active Off-Day routine for the person who performs the Very Active Core routine and who is seeking to lose weight. The Very Active Off-Day routine is performed two to three times per week on days in which the Very Active Core routine is not performed.

The Very Active Off-Day routine begins with a warm-up thirty minutes using either a bike at one hundred or more RPMs with high tension, walking at 2.2 MPH on a steep incline or using an elliptical trainer or stepper with high resistance. Next, the stretching routine discussed above is performed (arm circles, triceps, upper back and chest stretch, spine twist, hamstrings, legs-apart hamstrings, groin, quadriceps, and calves) for two to four minutes. After stretching, the person performs an aerobic interval of ten minutes of jumping rope followed by fifty repetitions for each exercise and in the order of sit-ups, leg-outs, elbows to knees, and knees to elbows.

After the abdominal exercises, the person performs thirty repetitions of squat thrusts followed b one minute of side benders and another thirty repetitions of squat thrusts. Lastly, the person performs five minutes of jump rope followed by a cool down of two to three minutes of either leisurely biking or walking.

The foregoing has described the principles and example embodiment, exercises, equipment, and routines of the present invention. However, the invention should not be construed as being limited to the particular example embodiment, exercises, equipment, and routines described above, as they should be regarded as being illustrative and not as restrictive. It should be appreciated that variations may be made in those example embodiment, exercises, equipment, and routines by those skilled in the art without departing from the scope of the present invention.

While an example embodiment of the present invention has been described above, it should be understood that it has been presented by way of example only, and not limitation. Thus, the breadth and scope of the present invention should not be limited by the above described exemplary embodiment.

Obviously, numerous modifications and variations of the present invention are possible in light of the above teachings. It is therefore to be understood that the invention may be practiced otherwise than as specifically described herein.

What is claimed as new and desired to be secured by Letters Patent is:

1. A method for prescribing a fitness programs for a person comprising the steps of: establishing a plurality of body types based on the shape of the body of the person: classifying the body of the person into one of said plurality body types; establishing a fitness level and a fitness goal for the person: and based on the body type classification, fitness level and fitness goal of the person, prescribing a first aerobic routine for the person to perform;

prescribing a first upper body routine for the person to perform;

prescribing a second aerobic routine for the person to perform; and prescribing a first abdominal routine for the person to perform.

2. The method of claim 1, wherein the step of establishing a plurality of body types includes establishing at least a first body type, a second body type, a third body type, and a fourth body type.

3. The method of claim 2, further comprising the step of:

for a person with a body classified into said first body type;

prescribing a third aerobic routine for the person to perform;

prescribing a set of standing knee to opposite chest for the person to perform;

prescribing a set of L-kicks for the person to perform;

prescribing a second upper body routine for the person to perform; and prescribing a fourth aerobic routine for the person to perform.

4. The method of claim 3, wherein the fitness program is prescribed with a sequence of said first aerobic routine, said set of standing knee to opposite chest, said set of L-kicks, said second aerobic routine, said first upper body routine, said third aerobic routine, said first abdominal routine, said second upper body routine, and said fourth aerobic routine.

5. The method of claim 2, further comprising the step of:

for a person with a body classified into said second body type;

prescribing a first and second set of standing knee to opposite chest for the person to perform;

prescribing a set of push-ups for the person to perform; and prescribing a third aerobic routine for the person to perform.

6. The method of claim 5, wherein the fitness program is prescribed with a sequence of said first set of standing knee to opposite chest, said set of push-ups, said first aerobic routine, said first upper body routine, said second aerobic routine, said first abdominal routine, said second set of standing knee to opposite chest, and said third aerobic routine.

7. The method of claim 2, further comprising the step of:

for a person with a body classified into said third body type;

prescribing a second abdominal routine for the person to perform;

prescribing a first and second set of march in place on toes for the person to perform;

prescribing a first and second set of side benders for the person to perform; and prescribing a first and second set of deadlifts for the person to perform.

8. The method of claim 7, wherein the fitness program is prescribed with a sequence of said first abdominal routine, said first aerobic routine, said first set of march in place on toes, said first set of side benders, said first set of deadlifts, said first upper body routine, said second aerobic routine, said second set of march in place on toes, said second set of side benders, said second abdominal routine, and said second set of deadlifts.

9. The method of claim 2, further comprising the step of:

for a person with a body classified into said fourth body type;

prescribing a first set of deadlifts for the person to perform;

prescribing a first and second set of side benders for the person to perform;

prescribing a second abdominal routine for the person to perform;

prescribing a first set and second set of march in place on toes for the person to perform; and prescribing a second upper body routine for the person to perform.

10. The method of claim 9, wherein the fitness program is prescribed with the sequence of said first aerobic routine, said first upper body routine, said first set of deadlifts, said first set of side benders, said first abdominal routine, said second aerobic routine, said first set of march in place on toes, said second upper body routine, said second first set of march in place on toes, said second abdominal routine, and said second set of side benders.

11. The method of claim 1, further comprising the steps of:

establishing a plurality of fitness levels for each of said plurality of body types;

classifying the body of the person into one of said plurality of fitness levels;

and wherein the steps of prescribing said first and said second aerobic routine, said upper body routine, and said abdominal routine are based on said classification of the body of the person into one of said plurality of fitness levels.

12. The method of claim 1, wherein the step of prescribing an upper body routine includes prescribing the exercises of push-outs, behind-the-neck presses, front presses, upright rows, bicep curls, and tricep kickbacks; and the step of prescribing an abdominal routine includes prescribing the exercises of sit-ups, leg-outs, elbows to knees, and knees to elbows; and wherein the resistance level of said prescribed exercises is based on the body type classification of the person.

13. The method of claim 1, wherein the step of prescribing the steps of prescribing a first and second aerobic routine includes prescribing one of the exercises from the group of biking and walking; and wherein the resistance level of said prescribed aerobic routine is based on the body type classification of the person.

14. A method for prescribing a fitness programs for a person comprising the steps of:

establishing a plurality of body types based on the shape of the body of the person;

classifying the body of the person into one of said plurality of body types;

establishing a plurality of fitness levels for each of said plurality of body types;

classifying the body of the person into one of said plurality of fitness levels;

prescribing an aerobic exercise for the person to employ, based at least in part, on the body type classification of the person; and identifying the proportion of aerobic versus anaerobic exercise the person should employ based, at least in part, on the fitness level classification of the body.

15. The method of claim 14 further comprising the step of identifying an aerobic exercise that the person should not employ according to the body type classification of the person.

16. The method of claim 14 further comprising the step of prescribing a resistance level for the prescribed aerobic exercise based, at least in part, on the body type classification of the person.

17. The method of claim 14, further comprising the step of prescribing a speed range level for the prescribed aerobic exercise based, at least in part, on the fitness level classification of the person.

18. A method for prescribing a fitness programs for a person comprising the steps of:

establishing a plurality of body types based on the shape of the body of the person;

classifying the body of the person into one of said plurality of body types; based on the body type classification of the person, prescribing a first aerobic routine for the person to perform comprising at least one of the exercises selected from the group of biking, walking, elliptical trainer, and stepper;

prescribing a first aerobic routine for the person to perform comprising the exercises of push-outs, behind-the-neck presses, front presses, upright rows, bicep curls, and tricep kickbacks;

prescribing a second aerobic routine for the person to perform comprising at least one of the exercises selected from the group of biking, walking, elliptical trainer and stepper;

prescribing a first abdominal routine for the person to perform comprising the exercises of sit-ups, leg-outs, elbows to knees, and knees to elbows; and wherein the resistance level of the prescribed aerobic exercise is based, at least in part, on the body type classification of the person.

19. The method of claim 18, further comprising the steps of:

establishing a plurality of fitness levels for each of said plurality of body types;

classifying the body of the person into one of said plurality of fitness levels; and prescribing a speed range for the prescribed aerobic exercise based, at least in part, on the fitness level classification of the person.

20. A fitness method for a person having a particular body type classification based on the shape of the person's body, a fitness level of the person, and a fitness goal for the person, said fitness method comprising the steps of:

performing a first aerobic routine with the resistance level based, at least in part, on the body type classification of the person and comprising at least one of the exercises selected from the group of biking, walking, elliptical trainer, and stepper;

performing a first upper body routine comprising the exercises of push-outs, behind-the-neck presses, front presses, upright rows, bicep curls, and tricep kickbacks;

performing a second aerobic routine with the resistance level based, at least in part, on the body type classification of the person and comprising at least one of the exercises selected from the group of biking, walking, elliptical trainer, and stepper; and performing a first abdominal routine comprising the exercises of sit-ups, leg-outs, elbows to knees, and knees to elbows.

21. A fitness method for a person having a particular body type classification based on the shape of the person's body, a fitness level of the person, and a fitness goal for the person, said fitness method comprising the steps of:

performing a first aerobic routine;

performing a first upper body routine;

performing a second aerobic routine;

performing a first abdominal routine.

22. The fitness method of claim 21, further comprising the steps of:

performing a third aerobic routine;

performing a set of standing knee to opposite chest;

performing a set of L-kicks;

performing a second upper body routine; and performing a fourth aerobic routine.

23. The method of claim 22, wherein the fitness method is performed with a sequence of said first aerobic routine, said set of standing knee to opposite chest, said set of L-kicks, said second aerobic routine, said first upper body routine, said third aerobic routine, said first abdominal routine, said second upper body routine, and said fourth aerobic routine.

24. The fitness method of claim 21, further comprising the steps of:

performing a first and second set of standing knee to opposite chest;

performing a set of push-ups; and performing a third aerobic routine.

25. The method of claim 24, wherein the fitness method is performed with a sequence of said first set of standing knee to opposite chest, said set of push-ups, said first aerobic routine, said first upper body routine, said second aerobic routine, said first abdominal routine, said second set of standing knee to opposite chest, and said third aerobic routine.

26. The method of claim 21, further comprising the steps of:

performing a second abdominal routine;

performing a first and second set of march in place on toes;

performing a first and second set of side benders; and performing a first and second set of deadlifts.

27. The method of claim 26, wherein the fitness method is performed with a sequence of said first abdominal routine, said first aerobic routine, said first set of march in place on toes, said first set of side benders, said first set of deadlifts, said first upper body routine, said second aerobic routine, said second set of march in place on toes, said second set of side benders, said second abdominal routine, and said second set of deadlifts.

28. The method of claim 21, further comprising the step of:

performing a first set of deadlifts;

performing a first and second set of side benders;

performing a second abdominal routine;

performing a first set and second set of march in place on toes; and performing a second upper body routine.

29. The method of claim 28, wherein the fitness method is performed with a sequence of said first aerobic routine, said first upper body routine, said first set of deadlifts, said first set of side benders, said first abdominal routine, said second aerobic routine, said first set of march in place on toes, said second upper body routine, said second first set of march in place on toes, said second abdominal routine, and said second set of side benders.

30. The fitness method of claim 21, wherein the resistance level of the exercise routines performed is based, at least in part, on the body type classification of the person.

31. The fitness method of claim 21, wherein the steps of performing said first and second aerobic routines includes exercises from the group of biking and walking; and wherein the resistance level of said exercise performed during said first and second aerobic routines is based, at least in part, on the body type classification of the person.

* * * * *